US005148557A

United States Patent [19]

Fridman et al.

[11] Patent Number: 5,148,557

[45] Date of Patent: Sep. 22, 1992

[54] INVALID LIFT AND TRANSPORT APPARATUS

[76] Inventors: Vladimir Fridman, 404 Little Tor Rd., New City, N.Y. 10956; Stanley R. Rosen, 8 Gerardine Pl., Spring Valley, N.Y. 10977

[21] Appl. No.: 572,260

[22] Filed: Aug. 27, 1990

[51] Int. Cl.[5] ..... A61G 7/08

[52] U.S. Cl. ..... 5/81.1; 5/86.1

[58] Field of Search ..... 5/81 R, 81 B, 83, 86

[56] References Cited

U.S. PATENT DOCUMENTS

| | | | |
|---|---|---|---|
| 869,325 | 10/1907 | Oehrmann | 5/81 |
| 2,494,591 | 1/1950 | Smith | 5/86 |
| 3,222,029 | 12/1965 | Hildemann | 5/81 |
| 3,234,568 | 2/1966 | Fischer | 5/89 |
| 3,877,421 | 4/1975 | Brown | 5/81 B |
| 4,138,750 | 2/1979 | Michalowski | 5/86 |
| 4,221,011 | 9/1980 | Flinchbaugh | 5/86 |
| 4,399,572 | 8/1983 | Johansson | 5/81 R |
| 4,510,633 | 4/1985 | Thorne | 5/81 R |
| 4,807,897 | 2/1989 | Schultz | 5/83 |
| 4,890,853 | 1/1990 | Olson | 5/81 R |

FOREIGN PATENT DOCUMENTS

| | | | |
|---|---|---|---|
| 1282275 | 7/1972 | United Kingdom | 5/81 R |
| 84/02074 | 6/1984 | World Int. Prop. O. | 5/81 R |

*Primary Examiner*—Renee S. Luebke
*Assistant Examiner*—Michael J. Milano
*Attorney, Agent, or Firm*—Philip Furgang

[57] ABSTRACT

A lifting mechanism, on a carriage assembly, supports a body support assembly to lift transport and thereafter set down a person. A back safety belt, carried by a pair of belt support holders, provides a first body support. The holders must be disposed in slots defined by "C" shaped members carried by arms carried by the lifting mechanism, before a leg support device can be hung from rivets carried by the holders. The leg support device is disposed beneath the person's legs proximate their knees and includes a board supported at its ends by clevises hung from the rivets, and a belt or belts passed over a person's legs and belted in place; and constitutes a second body support. A chest support device, constituting a third body support, is also carried by the lifting mechanism and is disposed to receive thereagainst the chest of a person being lifted, transported and lowered. The leg support device cannot be utilized unless the back support device is in place. In an alternative embodiment the chest support is spring biased and pivotally mounted to coact with a locking lever which includes a finger projecting into the path of disposition of at least one back support holder to prevent disposition thereof and hanging of the leg support device, unless force is applied to the chest support device as by a person leaning thereagainst. Another embodiment provides for adjustment of the chest support device between six degree and forty-five degree positions; while a still further embodiment provides screw adjustable spacing of carriage frame members.

34 Claims, 5 Drawing Sheets

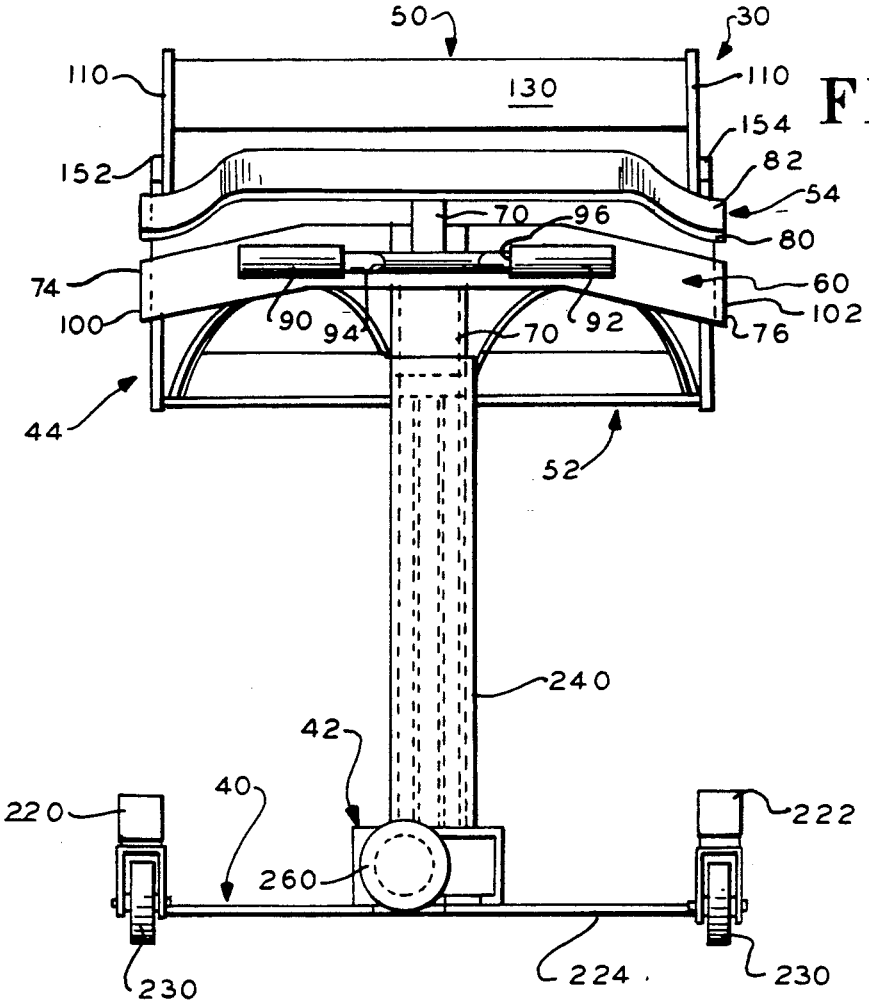
FIG. 2
FIG. 3
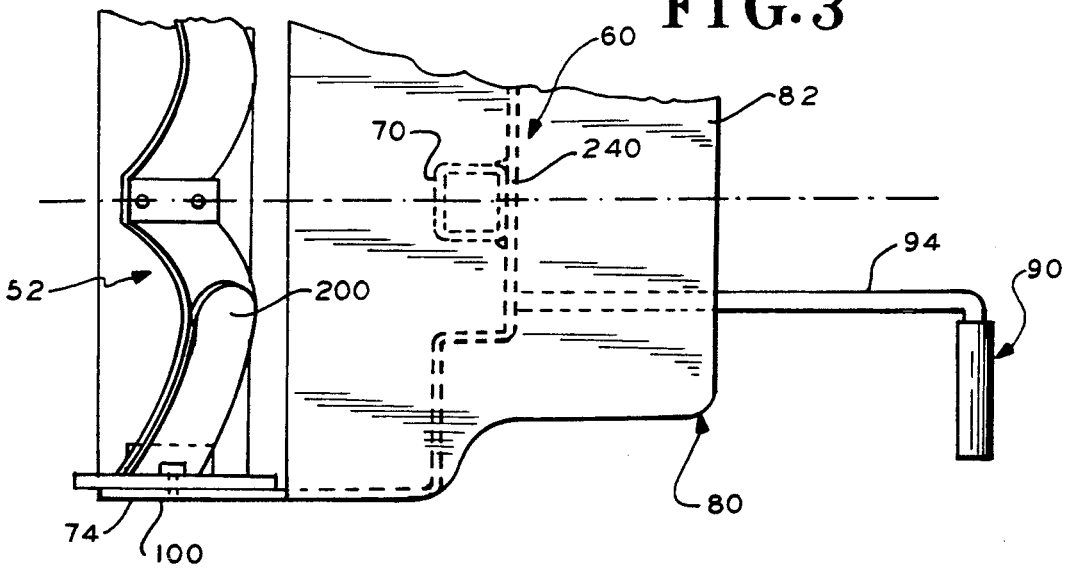

INVALID LIFT AND TRANSPORT APPARATUS

BACKGROUND OF THE INVENTION-FIELD OF APPLICATION

This invention relates to apparatus for use by invalids; and, more particularly, to apparatus for use in lifting and transporting invalids.

BACKGROUND OF THE INVENTION-DESCRIPTION OF THE PRIOR ART

Many devices and various constructions and configurations of apparatus exist for use in lifting and/or, transporting persons who for one reason or another are disabled or are an invalid. Such disabled or invalid persons may be hospitalized and temporarily relegated to an invalid condition due to the hospitalization; or they may be permanently disabled or invalid whether resident at home or in a hospital, nursing home or other institution.

Some such devices and apparatus may merely facilitate the lifting of the disabled and invalid person as shown, for example, in U.S. Pat. No. 2,187,283 granted on Jan. 16, 1940 to J. A. Scheutz for *Elevator Apparatus;* or they may facilitate the lifting and movement of the disabled and invalid person as shown, for example, in U.S. Pat. No. 4,138,750 granted on Feb. 13, 1979 to J. Michalowski for *Apparatus For Handling Disabled Persons* and in U.S. Pat. No. 4,700,416 granted on Oct. 20, 1987 to P. J. Johansson for *Patient Transfer Mat.* However, the elevator shown in the Scheutz patent does not and cannot function in conjunction with and as a transport device; while the sling of the Michalowski device and the transfer mat of Johansson must be placed under the invalid or disabled person, including their buttock area and that requires lifting of the person in order to position the person with respect to the device prior to its use in lifting the person. Lifting an invalid or disabled person more often than not requires the lifting of dead weight which may, for relatively heavy people, be considerable and necessitate the use of two or more persons to do so. This may be costly, time consuming and necessitates the availability of personnel which renders such lifting and transport devices inconvenient and undesirable.

Some apparatus for use by disabled and invalid persons, as shown: in U.S. Pat. No. 3,165,314 granted on Jan. 12, 1965 to J. P. Clearman et al for *Invalid Walker And Ambulatory Aid;* in U.S. Pat. No. 3,394,933 granted on Jul. 30, 1968 to R. A. Benoit for *Invalid Lifting And Supporting Device;* in U.S. Pat. No. 3,629,880 granted on Dec. 28, 1971 to J. N. van Rhyn for *Apparatus For Assisting Invalids;* and in U.S. Pat. No. 4,807,897 granted on Feb. 28, 1989 to J. R. Schultz for *Standing Support* all require the invalid user to assume a standing position which may not be possible due to the user's physical condition or disability or their available strength at a particular time or which may be painful and difficult for the user due to such conditions. These types of apparatuses do not provide support for the user's back if needed, and effect their lifting and support by applying forces to the user's chest only (as shown for the Clearman et al device) or beneath the user's armpits (as shown for the Benoit and Van Rhyn devices).

Apparatus, such as shown in U.S. Pat. No. 3,041,636 granted on Jul. 3, 1962 to A. B. Twedt for *Invalid Lifter And Transporting Device,* firstly places the user in an uncomfortable and awkward position and then effects the lifting of the person by applying sufficient force against only the person's back to effect movement of the person from their seated position. Such devices are additionally undesirable because they cannot lift a person from one level to another, appear to be quite unstable and place the user in a most awkward and obviously uncomfortable position during transport.

An invalid may be more comfortable being lifted and transported by an apparatus of the construction shown in U.S. Pat. No. 2,747,652 granted on May 29, 1956 to G. E. Marsh for *Device For Moving Invalids And The Like* which only supports the user by rigid panels that must be disposed beneath the user's buttocks; or by an apparatus of the construction shown in U.S. Pat. No. 4,569,094 granted on Feb. 11, 1986 to L. D. Hart et al for *Self-Powered Lift* which only supports the user by a flexible strap that must be disposed beneath the user's buttocks. Alternatively, the lifting and transport apparatus may support the user under their buttocks and behind their back as well as shown in U.S. Pat. No. 3,623,169 granted on Nov. 30, 1971 to D. R. James for *Apparatus For Handling Disabled Persons,* in U.S. Pat. No. 4,510,633 granted on Apr. 16, 1985 to M. W. Thorne for *Invalid Transfer Means,* in U.S. Pat. No. 3,732,584 granted on May 15, 1973 to D. R. James for *Apparatus For Handling Disabled Persons* or under their buttocks against their knees and with a chest support as shown in U.S. Pat. No. 4,157,593 granted on Jun. 12, 1979 to N. L. O. Kristensson for *Patient Lift And Transport Apparatus.* The undesirability and unacceptability of inserting a patient lifting apparatus beneath a patients buttocks is described at length above. Efforts required to lift the person or otherwise place the under buttocks support beneath the patients buttocks requires people, strength and time and in many instances may prove to be uncomfortable and/or painful to the patient. Many of these devices also place the patient in a most uncomfortable position while being lifted and during transport.

U.S. Pat. No. 3,996,632 granted on Dec. 14, 1976 to A. C. Bakker nee Viel for *Detachable Coupling* and U.S. Pat. No. 4,409,696 granted on Oct. 18, 1983 to J. P. Bakker for *Apparatus For Carrying A Person In Sitting Condition* show lifting and transport devices which support and lift the person beneath their upper leg proximate their knees and which provide a back support. However, the disposition of the persons weight when being lifted and transported by such devices may render the device unstable and unsafe unless the person's weight is counterbalanced by the weight and disposition of the structure of the device. This may very well render the device relatively unduly heavy, cumbersome and costly.

None of the lifting and/or transport devices described above are constructed to assure that the person to be lifted is properly and safely secured in position, or that the person's weight is distributed in such a manner that the device is stable and secure while lifting and transporting the person without unduly adding to the weight and cost of the device. Even a device such as shown in U.S. Pat. No. 4,704,749 granted on Nov. 10, 1987 to B. A. Aubert for *Body Lift And Walker For Paralytics* which interconnects its under arm supports to its leg supports, does not insure the security of the person when carried by the device. In addition this type of device requires the application of the user's weight to supports that are disposed beneath the user's arm pits in order to function. If the medical or physical condition of the user does not permit application of the user's weight in this manner the device is inoperable and of no value or use to lift or transport the person.

SUMMARY OF THE INVENTION

It is therefore an object of this invention to provide a new and improved invalid lift.

It is another object of this invention to provide a new and improved invalid transport device.

It is still another object of this invention to provide a new and improved invalid lift and transport apparatus.

It is yet still another object of this invention to provide a new and improved invalid lift and transport apparatus wherein the weight of the person to be lifted and transported is distributed so as to facilitate a stable lifting and transporting of the person.

It is a further object of this invention to provide a new and improved invalid lift and transport device wherein the person to be lifted and transported is disposed to facilitate a stable lifting and transportation.

It is still a further object of this invention to provide a new and improved invalid lift and transport device which disposes the person to be lifted so that their buttocks are unobstructed to facilitate medical treatment and body functions.

It is yet still a further object of this invention to provide a new and improved invalid lift and transport device which provides a relatively high level of patient safety.

It is yet still a further object of this invention to provide a new and improved invalid lift and transport apparatus which enforces use of a backrest in order to render the apparatus effectively usable and thus provides for a relatively high degree of person safety.

It is yet still a further object of this invention to provide a new and improved invalid lift and transport apparatus which enforces a particular disposition of the person to be lifted and transported and thereby use of a backrest in order to render the apparatus effectively usable and thus provides for a relatively high degree of person safety.

Other objects, features and advantages of the invention in its details of construction and arrangement of parts will be seen from the above and from the following description of the preferred embodiments when considered with the drawing and from the appended claims.

BRIEF DESCRIPTION OF THE DRAWING

In the drawing:

FIG. 2 is an end elevation view of the apparatus of FIG. 1;

FIG. 3 is a partial top view of the apparatus of FIGS. 1 and 2 enlarged to better show details thereof;

DESCRIPTION OF THE PREFERRED EMBODIMENTS

Figures 1, 4, 5:
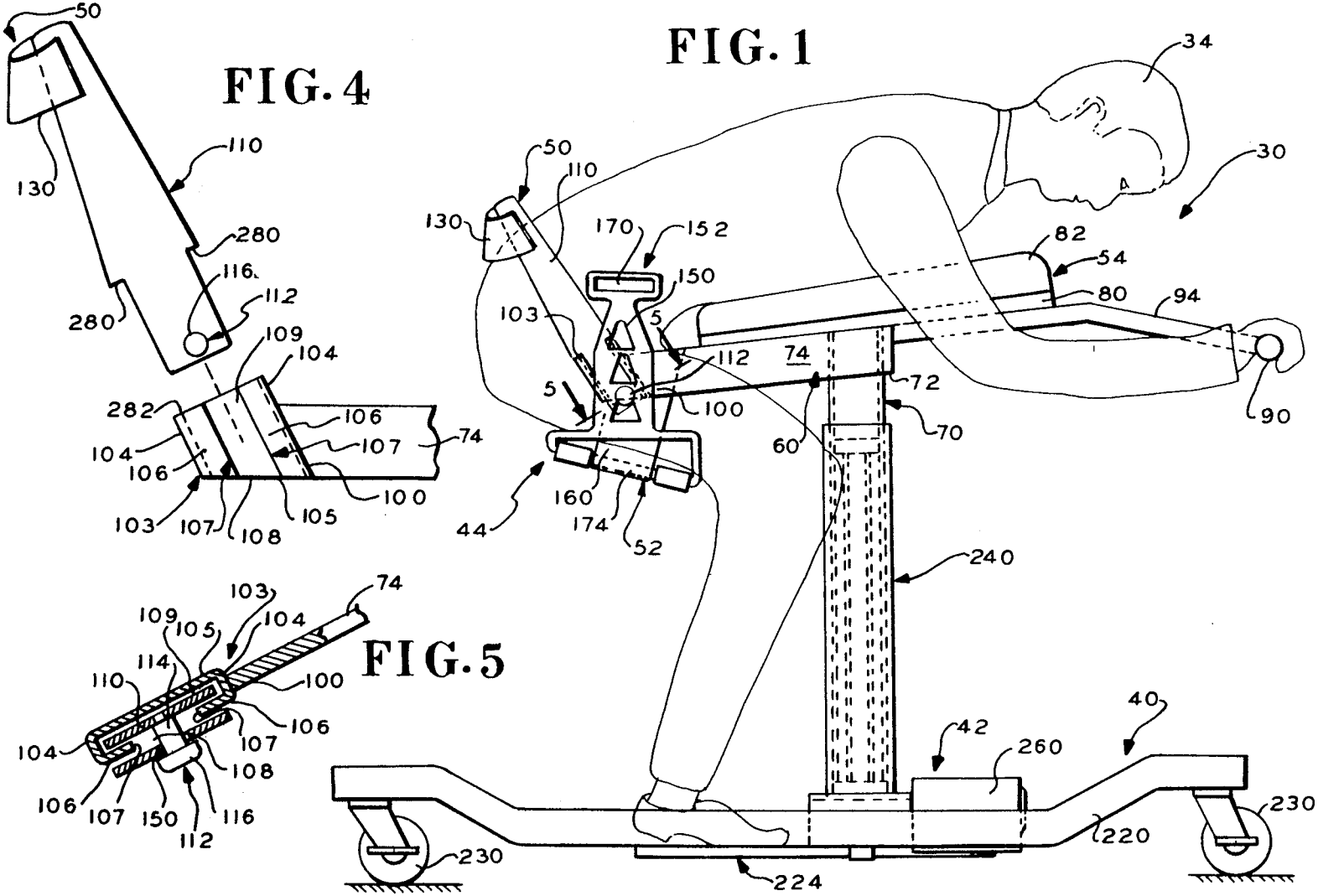
FIG. 1 is a side elevation view of an invalid lift and transport apparatus incorporating the instant invention and schematically showing a person disposed thereon.
FIG. 4 is an exploded view of the back support device and part of the support arm of the apparatus of FIGS. 1 and 2 enlarged to better show details thereof.
FIG. 5 is a sectional view taken on line 5—5 of FIG. 1 further enlarged to better show details thereof.

With reference to FIGS. 1 and 2 there is generally shown at 30 an invalid lift and transport device or apparatus for lifting a person 34 (FIG. 1) from a seating position on a chair or other support (not shown), for transporting that person 34 once positioned on apparatus 30 for transport and for again lifting person 34 and depositing person 34 on another or the same chair or support.

Apparatus 30 includes a carriage assembly 40, a lifting mechanism 42 (which also lowers) carried by carriage assembly 40 and a body support assembly 44 carried by lifting mechanism 42. Body support assembly 44, in turn, includes a first body support portion 50 which functions as a back support device, a second body support portion 52 which functions as a leg support device and a third body support portion 54 which functions as a chest support device; with all such devices 50, 52, 54 of body support assembly 44 being mounted atop lifting mechanism 42 through a mounting assembly 60 (FIGS. 1-3).

A lifting tube 70, of lifting mechanism 42, has fixedly secured proximate its top 72 a pair of lifting arms 74 and 76 (FIGS. 2 and 3) of mounting assembly 60 symmetrically mounted with respect to lifting tube 70 and secured thereto as by welding or other suitable and conventional means. A chest support plate 80 (FIGS. 1-3) is secured on top of arms 74, 76 and in turn supports a chest support pillow 82; with plate 80 and pillow 82 comprising chest support device 54 of body support assembly 44. Plate 80 may be formed of metal, plastic wood or other suitable material and forms a base for pillow 82 which may be formed with a firm core (not shown) and covered with a suitable material such as leather, plastic, cloth or the like. A pair of handles 90 and 92 (FIG. 2) are carried by handle arms 94, 96 respectively which, in turn, extend from and are suitably secured to lifting arms 74, 76 respectively. Chest support plate 80 and its pillow 82 may, if desired, also be supported by handle arms 94, 96. It should be noted that lifting arms 74, 76 and handle arms 94, 96 support chest support plate 80 at a predetermined angle to the horizontal and which facilitates disposition and support of person 34 thereupon as will be hereinafter described. The predetermined angle for plate 80 and pillow 82 of chest support device 54 may be selected to be between six and 45 degrees.

Each lifting arm 74, 76 at the respective ends 100, 102 (FIG. 2) thereof, opposite to where such arms 74, 76 are secured to lifting tube 70, carries a substantially "C" shaped channel member 103 (FIGS. 4 and 5) which may either be formed integrally therewith or secured thereto by suitable means such as welding or the like. A pair of opposed and spaced sidewalls 104 extend out from a back wall 105 of channel member 103, and front strips 106 extend inwardly from each sidewall 104 to terminate in edges 107 spaced from each other and defining therebetween an opening 108 extending the length of channel member 103. The inner surfaces of sidewalls 104, back wall 105 and front strips 106 define therewithin a channel 109 extending the length of channel member 103 and communicating its entire length with opening 108. Channel 109 is of a size and configuration to receive a back support holder 110 (FIGS. 1, 4 and 5) of back support device 50 of body support assembly 44. Since channel members 103, formed at respective ends 100, 102 of lifting arms 74, 76 are identical only channel member 103 of arm 74 has been shown in detail (in FIGS. 4 and 5), with channel member 103 of arm 76 being identical to and a mirror image thereof. A back support holder 110 (FIG. 2) is disposed at each side of back support device 50. Each back support 110 includes a seat device support rivet 112 (FIGS. 4 and 5) disposed proximate one end thereof and formed with a shank portion 114 and a head portion 116 (FIG. 5). Back support holders 110, are each respectively disposed in their channels 106 with their respective rivets 112 pointing outwardly through openings 120 (FIG. 4) which extend the lengths of the respective channels 106. A back support safety belt 130 (FIGS. 2 and 4) connects back support holders 110 together at their respective upper ends (i.e. the ends thereof opposite from rivets 112) and forms with back support holders 110 back support device 50 of body support assembly 44. The length of back support holders 110 is selected so that back support safety belt 130 is disposed behind but in proximity to the back of person 34 when carried by lift 30.

Heads 116 (FIGS. 1 and 5) and shanks 114 (FIG. 5) of support rivets 112 are sized and configured to be received through support openings 150 (FIGS. 1, 5 and 6) of clevises 152, and 154 (FIG. 6) respectively of leg support device 52 of body support assembly 44. Openings 150 are shown to be of a substantially triangular configuration wider at their respective bottoms and coming to a point at their respective tops. As such heads 116 of rivets 112 can pass through the wide portions of openings 150 and be disposed outside of clevises 152, 154 when shanks 114 of rivets 112 are disposed proximate the respective tops of openings 150 where clevises 152, 154 will rest upon their respective shanks 114. When so disposed heads 116 of rivets 112 prevent clevises 152, 154 from moving off of shanks 114 of rivets 112 and thus hold clevises 152, 154 and leg support 160 suspended therefrom. Three support openings 150*a*, 150*b* and 150*c*, each of identical configuration and arrangement, are formed through each clevis 152, 154, but at different but aligned levels to facilitate dispositions of leg support 160 at different levels as will be hereinafter described. While support openings 150 are shown with a triangular configuration it should be understood that other suitable configurations, such as tear drop, keyhole or the like may also be utilized.

Each clevis 152, 154 (FIG. 6) is formed with a hand hole 170, 172 respectively extending therethrough proximate their upper ends and a seat support bar 174, 176 and openings 178, 180 extending therethrough proximate their lower ends. Leg support 160 is formed of relatively rigid material and so as to receive at its respective ends 186, 188 support bars 174, 176 respectively of clevises 152, 154 to be mounted thereon and supported thereby. Belt openings 190, 192 are formed through leg support 160 at ends 186, 188 respectively thereof of a size and configuration to permit passage therethrough of ends 194, 196 respectively of a leg belt 200. A pair of fasteners 202, such as rivets or the like, secure belt 200 to leg support 160 proximate the respective centers thereof. Velcro type fasteners 204*a*, 204*b* are carried by end 194 of belt 200 for respective coaction to secure end 194 of belt 200 in position about a leg of person 34 when disposed on leg support 160 as will be hereinafter described, and similar velcro type fasteners (not shown) are carried by end 196 of belt 200 is similar but mirror positions of fasteners 204*a*, 204*b* for positioning about the other leg of a person disposed on leg support 160. The respective ends 194, 196 of belt 200 are to be threaded through openings 190, 192 respectively (after passing over the respective legs of person 34 disposed on leg support 160) then under and about support bars 174, 176 respectively to be thereafter secured in place through mating coaction of their respective velcro type fasteners 204*a*, 204*b* as shown for belt end 196. Belt 200 may be formed of suitable and appropriate material such as leather, plastic or the like, with alternate suitable fastening means for the ends thereof, and, if preferred, as two separate belts each secured at one of its ends to leg support 160.

Carriage assembly 40 (FIGS. 1 and 2) includes a pair of spaced frame members 220 and 222 (FIG. 2) interconnected in spaced relationship by a cross-member 224 (FIGS. 1 and 2). A pair of wheels 230 are each rotatively carried at the respective ends of each frame member 220, 222; each such wheel 230 being equipped with conventional wheel brakes that may be selectively applied and released. The spacing between frame members 220, 222 is selected to accommodate therebetween a seated person 34 to be lifted, transported and reseated.

A vertically disposed lifting mechanism support column 240 (FIGS. 1, 2 and 3) extends up from cross-member 224 and is suitably and securely carried thereby. Support column 240 is hollow and supports therewithin lifting tube 70 for vertical up and down movement. While support column 240 and tube 70 are both shown as hollow tubes of substantially square cross-section they may just as well be formed to any other convenient hollow tubular cross-section.

Figure 7:
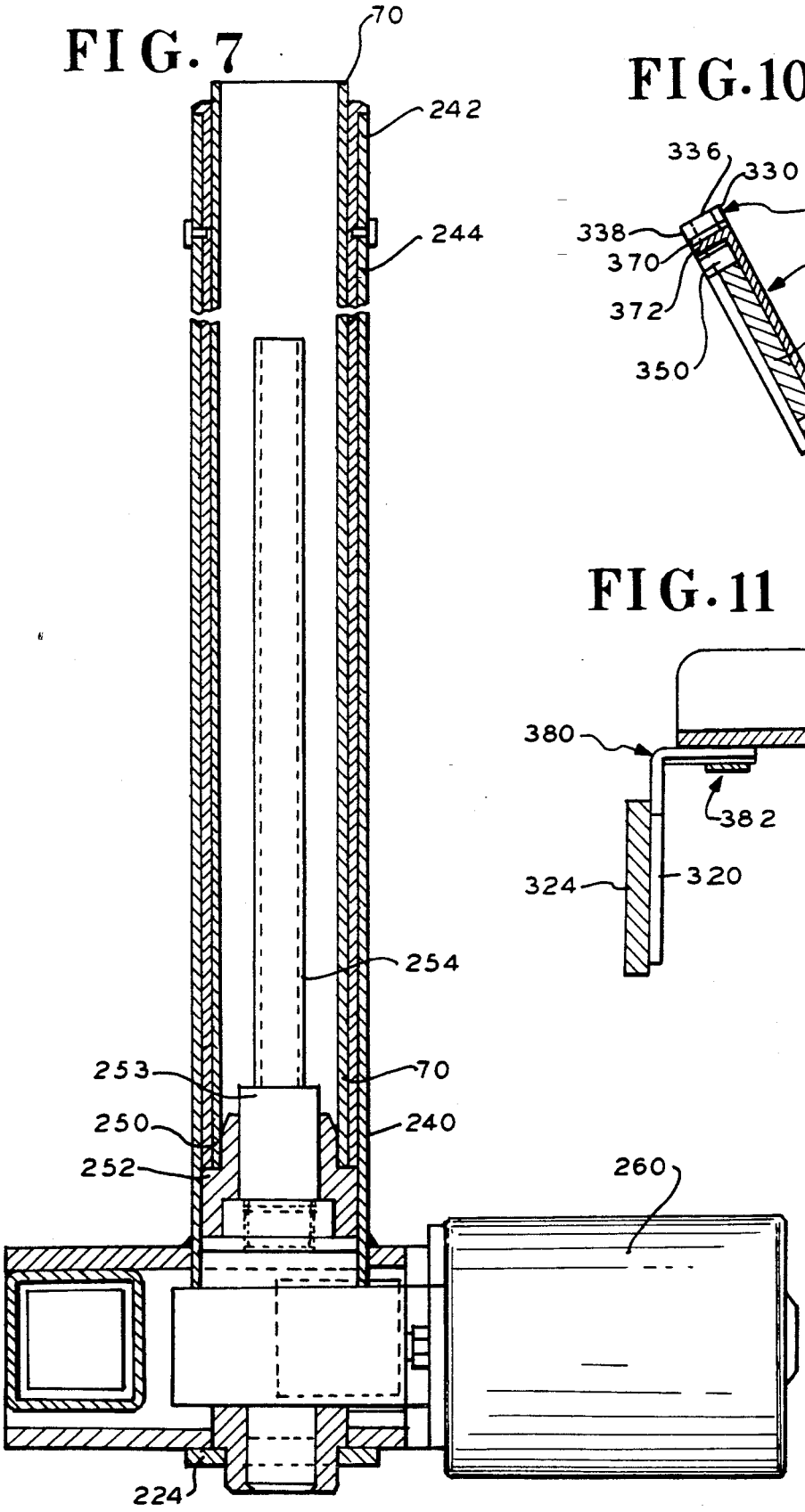
FIG. 7 is a vertical sectional view of the lifting mechanism of the device of FIGS. 1 and 2.
Figure 10:
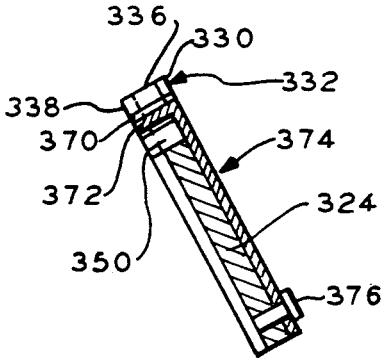
FIG. 10 is a sectional view taken on line 10—10 of FIG. 8.
Figure 11:
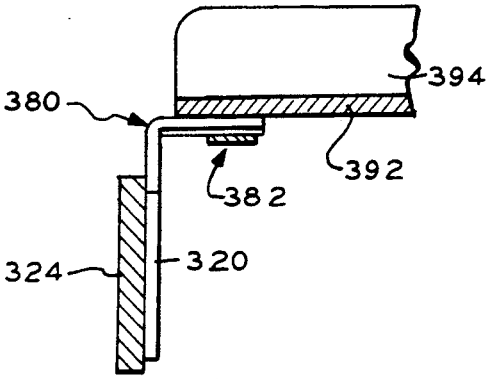
FIG. 11 is a sectional view taken on line 11—11 of FIG. 8.

A suitable bushing 242 (FIG. 7) is fixedly secured proximate an upper end 244 of support column 240 and receives for sliding movement therewithin lifting tube 70. A lower end 250 of lifting tube 70 rests upon a bushing 252. The latter rests on a ball nut 253 disposed for coaction with a ball screw 254 vertically disposed within column 240 and tube 70. Ball nut 252 and ball screw 254 are conventionally available and coacting devices with ball screw 254 thereof driven by a motor 260 suitably and appropriately interconnected to ball screw 254 and mounted to carriage assembly 40. Motor 260 may be connected by conventional means to a source of drive power or by conventional conductive means therefore. Appropriate and suitable controls are connected to and provided for motor 260 to energize and de-energize same, and to control the operation thereof for lifting and lowering of tube 70 and body support assembly 44 carried thereby.

When invalid lift and transport 30 is to be utilized it is wheeled to where person 34 is sitting and disposed with frame members 220, 222 positioned to each side of person 34 and their seat. Person 34 then leans over positioning their chest upon pillow 82 of chest support device 54 and grasping handles 90, 92 with their hands (as shown in FIG. 1). Prior to person 34 so positioning themselves lifting mechanism 42 may need to be operated to position chest support device 54 at a proper height. Once person 34 has been positioned upon chest support device 54 back support holders 110 are inserted into channels 109 with rivets 112 extending outwardly through openings 108 and until shoulders 280 (FIG. 4) formed on holders 110 bottom against an upper surface 282 of channel members 103. When holders 110 are so disposed back support safety belt 130 will be disposed behind the back of person 34 to secure them in position and prevent them from falling off lift 30 should they accidentally or unintentionally attempt to move back or to a sitting position.

Leg support 160 is then positioned beneath the thighs of person 34 proximate their knees and belt 200 thereof is secured in place over the legs of person 34 as hereinabove described. Clevises 152, 154 are then respectively positioned on back support holders 110 by passing openings 150 thereof over heads 116 of rivets 112 and having shanks 114 of rivets 112 rest beneath upper ends of openings 150. A suitable set of openings 150*a*, 150*b* or 150*c* is selected when so positioning leg support device 52 to accommodate the physical size and proportions of person 34. It should be noted that support bars 174, 176 of clevises 152, 154 are disposed at an angle to accommodate the seated disposition of person 34 and urge person 34 to a position against pillow 82.

With person 34 positioned as above described lifting mechanism 42 may be operated to raise lifting tube 70, body support assembly 44 and person 34. Once person 34 is free of their seat carriage 40 may be rolled (after the brakes for wheels 230 have been released if they have been applied) on wheels 230 to a new seat, toilet or other position. While person 34 is so positioned their buttocks are available for medical treatment or for performing body functions. Lifting mechanism 42 is then operated to lower body support assembly 44 (after wheels 230 are locked if so desired) and person 34 is deposited at their new location or back where they were originally. After person 34 is safely seated clevises 152, 154 may be raised, lifted off of rivets 112, leg belt 200 may thereafter be unstrapped and leg support device 52 removed from under the legs of person 34. Back support holders 110 may then be slid out from channels 109 of channel members 103, carriage wheels 230 unlocked and carriage 40 rolled away.

Lift and transport apparatus 30 shown and described above is relatively simple to use and can be operated by one person. The person being lifted and transported is disposed in a very stable position during lifting and transport. The apparatus is highly safe and reliable. When person 34 is disposed in position to be lifted and transported a substantial portion of their weight is supported on the chest support device 54. Leg support 160 is disposed at an angle to the horizontal to effect a force component that moves the body of person 34 forward. The requirement that back support device 50 be in position in order to attach leg support device 52 insures the relatively high degree of personal safety provided by lift and transport 30.

Figures 6, 8, 9:
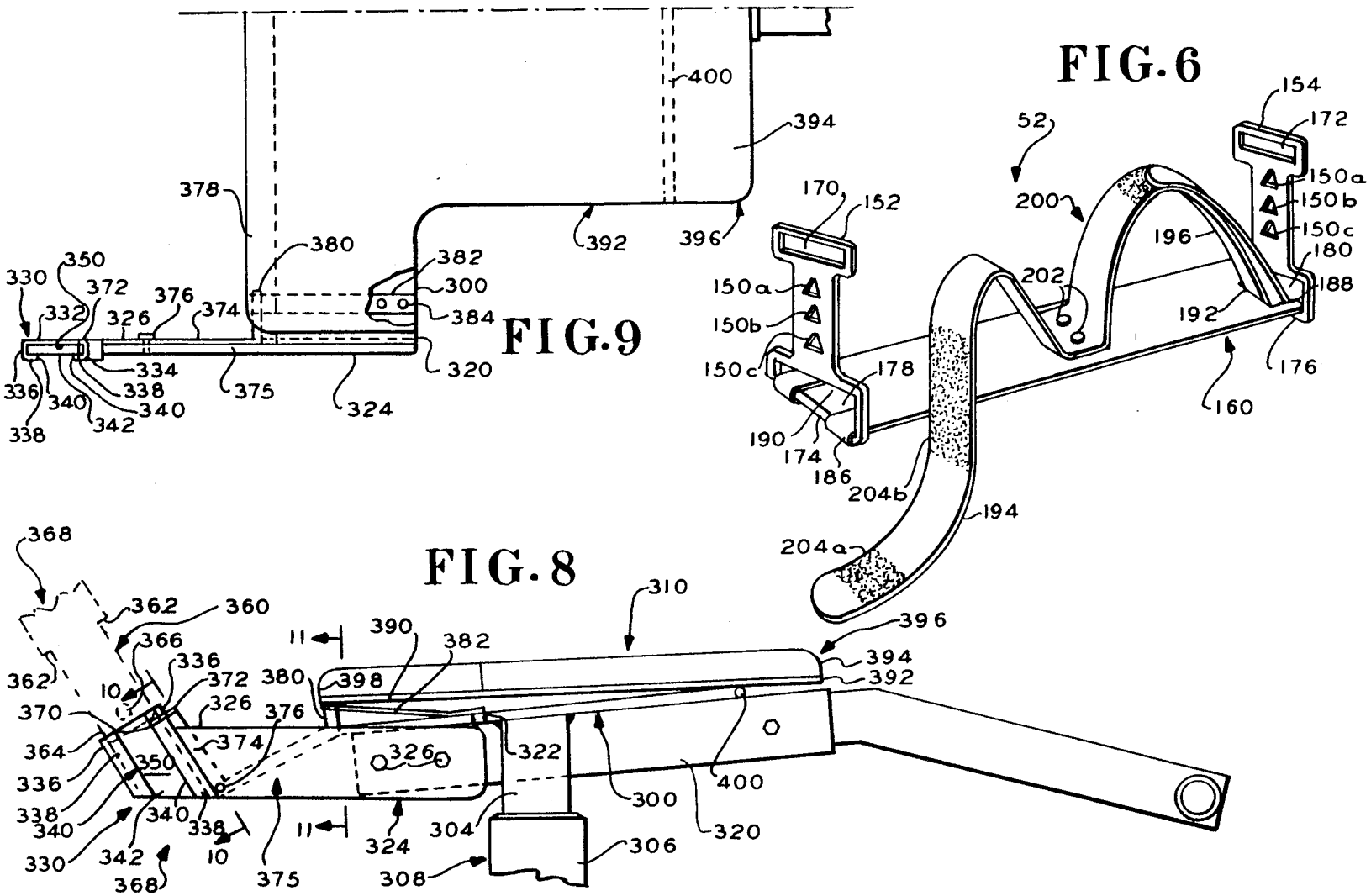
FIG. 6 is a perspective view of the leg support device of the apparatus of FIGS. 1 and 2 shown removed therefrom to better show details thereof.
FIG. 8 is a partial elevational view of a chest support device, support arm and back support holder of an alternate embodiment of invalid lift and transport apparatus showing a locking lever therefore and incorporating the instant invention and showing the locking lever in a free position.
FIG. 9 is a partial plan view of the apparatus of FIG. 8.

In the embodiment of FIGS. 8–12 an upper plate 300 (FIGS. 8 and 9) is secured, as by welding or the like, to the top 302 of a lifting tube 304 slidably disposed within a support column 306 of a lifting mechanism 308 of an alternative construction for an invalid lift and transport device 310. Lifting tube 304, support column 306 and lifting mechanism 308 are identical in construction and operation to lifting tube 70, support column 240 and lifting mechanism 42 of the embodiment of FIGS. 1–7. A pair of lifting arm mounting plates 320 (FIGS. 8–10) [only one shown] are each secured to and depend down from upper plate 300 at respective sides 322 thereof. A lifting arm 324 is secured to each such lifting arm mounting plate 320 as by threaded fasteners 326 (FIGS. 8 and 9).

Each lifting arm 324, at its respective end 326, opposite to where arms 324 are secured to their respective mounting plates 320, carries a substantially "C" shaped channel member 330 (FIGS. 8–10) which may either be formed integrally therewith or secured thereto by suitable means such as welding or the like. Channel members 330 are substantially identical in configuration and function to each other so only one such channel member 330 has been shown. They are also substantially identical in configuration and function to channel members 103 (FIGS. 4 and 5) of the embodiment of FIGS. 1–7 in that each such channel member 330 includes back wall 332 opposed and spaced sidewalls 334, 336 extend up from back wall 332 and front strips 338 terminating in edges 340 spaced from each other and defining an opening 342 extending the length of each respective channel member 330. The inner surfaces of back wall 332, sidewalls 334, 336, and front strips 338 define a channel 350 also extending the length of each channel member 330 and which communicates with opening 342.

Each channel 350, of channel members 330, is of a size and configuration to receive a back support holder 360 [only one shown in phantom in FIGS. 8 and 9]. Each back support holder 360 is constructed with a pair of shoulders 362 disposed to bottom against an upper surface 364 of channel members 330 when back support holders 360 are inserted into channels 350, and each back support holder carries a seat device support rivet 366 extending outwardly therefrom and carried thereby to extend out through openings 342. Back support holders 360 cooperate to mount therebetween and position a back support device 368, in the same manner that back support holders 110 (FIG. 1) support back support safety belt 130 of the FIGS. 1–7 embodiment, and, through rivets 366, a leg support device 368 in the same manner that rivets 112 of back support holders 110 support and mount leg support device 52 of FIGS. 1–7 embodiment.

Channel members 330, however, differ from channel members 103 (FIGS. 4 and 5) in that each channel member 330 includes a slot 370 (FIGS. 8 and 10) that extends through sidewall 336, near to upper surface 364 of channel member 330, and through the front strip 338 that extends inwardly from sidewall 336. Slot 370 is of a size and configuration to receive a locking finger 372 carried at one end of a locking lever 374 of a locking lever assembly 375 that is pivotally mounted at 376 to lifting arm 324. An actuating finger 380 (FIGS. 8–10) is carried at the other end of locking lever 374 extending out therefrom for coaction with an end of a flat spring 382 (FIGS. 8 and 9) the other end of which is secured to upper plate 300 as by threaded members 384 (FIG. 9) or the like. Spring 382 acts against actuating finger 380 and urges locking lever 374 in the counterclockwise direction about pivot 376 (FIG. 8) so that locking finger 372 seats in slot 370. When locking finger 372 is so seated in slot 370 it obstructs channel 350 so that a back support holder 360 cannot be inserted therein and by doing so prevents that side of the leg support device from being mounted on the rivet 366 carried by back support holder 360.

Spring 382 also acts against an underside 390 (FIG. 8) of a chest support plate 392 of a chest support pillow 394 of a chest support device 396 proximate a front edge 398 thereof. A chest support pivot 400 carried by chest support plate 392 and upper plate 300 pivotally mounts chest support device 396 to upper plate 300. Spring 382 urges chest support device 396 in the clockwise direction (FIG. 8) about pivot 400 and into its unsupporting position of FIG. 8..

Figure 12:
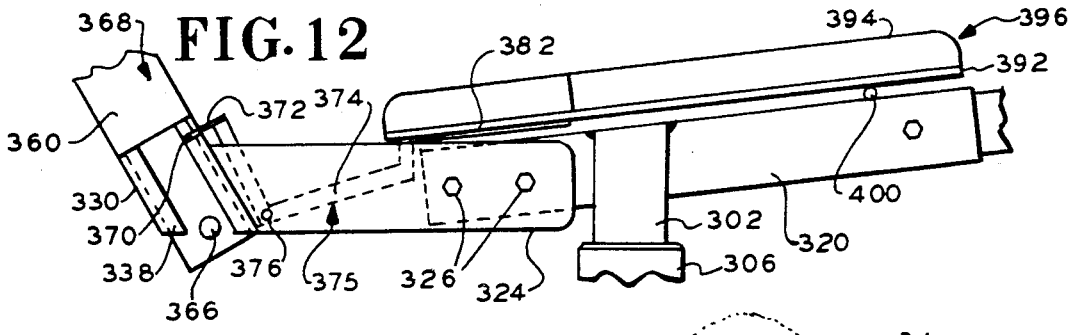
FIG. 12 is a view similar to that of FIG. 8 but showing the locking lever in a working position.

The application of suitable force upon chest support pillow 394 of chest support device 396, such as when a person 34 (FIG. 1) lays upon pillow 394 (FIG. 8) when preparing to and being moved by invalid lift and transport 310, pivots chest support device 396 counterclockwise (FIG. 8) about pivot 400 from its FIG. 8 unsupporting position to a person supporting position as shown in FIG. 12. The pivoting movement of chest support device 396, through front edge 398 thereof, acts upon actuating finger 380 pivot locking lever 374, against the urging of spring 382, in the clockwise direction (FIG. 8) about pivot 376 and moves locking finger 372 thereof out from slot 370 (FIG. 9). This removes finger 372 from obstructing channel 350 and will permit a back support holder 360 to be inserted in channel 350. Once so inserted rivet 366 is disposed to mount a leg support device and invalid lift and transport 310 is available to lift, transport and deposit a person.

Chest support device 396, back support device 368 and lifting mechanism 308 are otherwise identical in construction and operation to comparable devices of the lift and transport device of FIGS. 1–7 and serve to mount and operate a leg support device [not shown] such as leg support device 52 (FIG. 4). The described construction disposition and operation of locking lever assembly 375 and its coaction with chest support device 396 and back support holders 360 provides yet an additional measure of safety for device 310 in that it requires the person to be lifted and transported to be positioned upon chest support device 396 before the back support safety belt can be properly positioned. Without the proper positioning of the back support safety belt the leg support device cannot be properly positioned and without that the lift cannot be operated to lift and transport a person.

Figure 13:
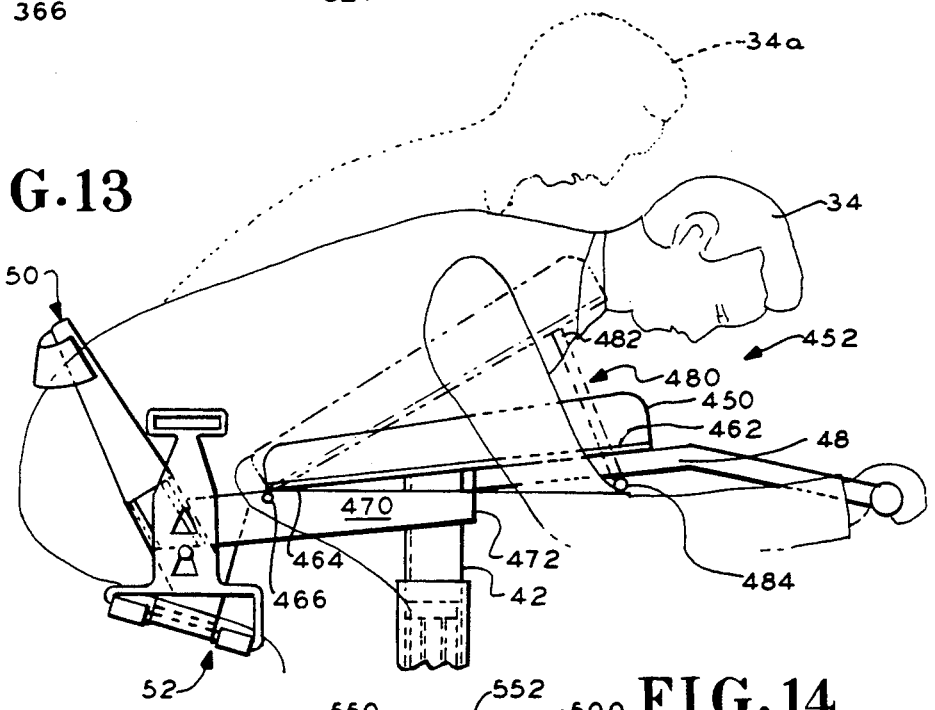
FIG. 13 is a side elevational view of an alternate construction of invalid lift and transport apparatus incorporating the instant invention and showing an alternative construction of chest support device.

In FIG. 13 there is shown an alternative construction of a chest support device 450 for an invalid lift and transport device 452. Device 452 otherwise utilizes a lifting mechanism 42, a back support device 50, and a leg support device 52 that are identical to such devices as described for lift 30 of FIGS. 1–7. In addition, chest support device 450 is identical to chest support device 54 of the FIGS. 1–7 embodiment except that its chest support pillow is carried by a chest support plate 462 that is pivoted proximate its forward end 464 by a pivot 466 carried by plate 462 and lifting arms 470 [only one shown] of lifting mechanism 472. Lifting arms 470 and lifting mechanism 472 are otherwise constructed, carried and function like lifting arms 74 and 76 of lifting mechanism 42 of lift 30 of the FIGS. 1–7 embodiment.

A pair of adjusters 480 (FIG. 13) [only one shown] are each secured at respective first ends 482 thereof to the underside of plate 462 proximate respective sides thereof and at respective second ends 484 thereof to handle arms 486 [only one shown]. Adjusters 480 are of conventional construction which readily permit increase or decrease of the respective lengths thereof (as by turning a center portion thereof) such that chest support device 450 can be disposed with its pillow 460 disposed at substantially an infinite number of selected angles between approximately six degrees to the horizontal as shown by person 34 in outline in FIG. 13 and forty-five degrees to the horizontal as shown by person **34*a* filled-in in FIG. 13**.

Figure 14:
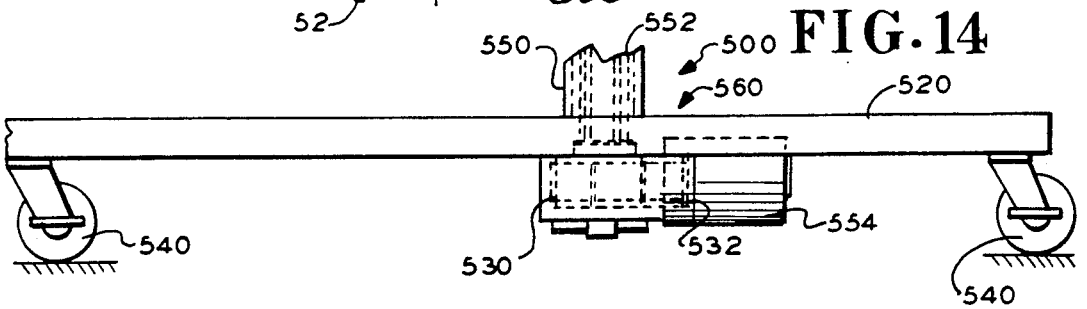
FIG. 14 is a side elevational view of another alternate construction of invalid lift and transport apparatus incorporating the instant invention and showing a width adjustable support for the carriage thereof.
Figure 15:
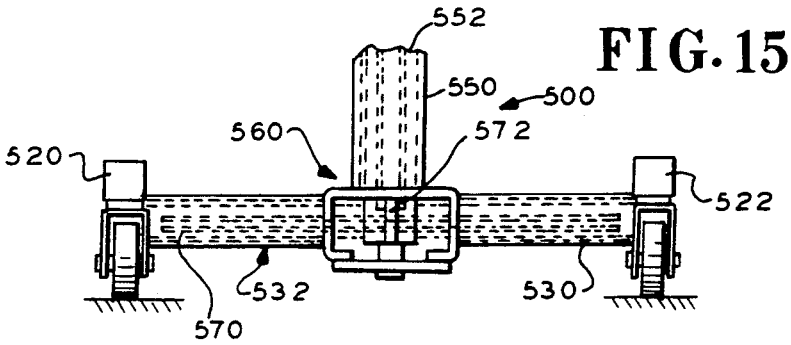
FIG. 15 is an end elevation view of the width adjustable support for the carriage of FIG. 14.

In FIGS. 14 and 15 there is shown a width adjustable carriage assembly 500 including a pair of spaced frame members 520 and 522 (FIG. 15) interconnected in spaced relationship by a pair of cross-beams 530, 532. A pair of wheels 540 are each rotatively carried at the respective ends of each frame member 520, 522; each such wheel 540 being equipped with conventional wheel brakes that may be selectively applied and released.

Cross-beams 530, 532 mount a support column 550 with an internal lifting tube 552 and motor 554 of a lifting mechanism 560 which is constructed and functions like lifting mechanism 42 of the FIG. 1–7 embodiment. Each cross-beam 530 and 532 includes an internal cross shaft 570 with external threads and an internally threaded adjustment nut 572 which upon adjustment effects uniform movement of frames 520, 522 (and wheels 540) inwardly or outwardly with respect to each other. Such adjustment facilitates spacing of frame members 520, 522 to accommodate seat of different width (such as chairs, wheelchairs, commodes, and the like).

From the above description it will thus be seen that there has been provided a new and improved invalid lift and transport apparatus which provides relatively safe lifting, transport, and deposition of a person by enforcing positioning of a person to be lifted and transported in a relative apparatus stable position and which provides and insures use of a back safety belt in order to utilize the apparatus.

It is understood that although I have shown preferred forms of my invention that various modifications may be made in the details thereof without departing from the spirit as comprehended by the following claims.

What is claimed is:

1. An invalid lift and transport apparatus; comprising:

(a) carriage means of a size and construction to carry a person;

(b) person lifting means carried by said carriage means for lifting and lowering a person with respect to said carriage means;

(c) person body support means carried by said lifting means;

(d) said person body support means including:

(1) a back support portion disposed to coact with a person's back when a person is to be carried by said carriage means; and (2) a leg support portion disposed to coact with a person's legs when a person is to be carried by said carriage means;

(e) said back support portion being readily positionable with respect to said lifting means to be carried thereby and readily removable from said lifting means; and (f) said leg support portion being readily positionable with respect to, carried by, and coacting with said lifting means only when said back support portion is carried by said lifting means.

2. The apparatus of claim 1, wherein said leg support portion is carried by said back support portion.

3. The apparatus of claim 2, wherein said person body support means also includes a chest support portion and locking means are carried by said lifting means for coaction with both said chest support portion and said back support portion; said locking means being responsive to a person's chest coacting with said chest support portion to enable said back support portion to be carried by said lifting means and thereby said leg support portion to be carried by said back support portion.

4. The apparatus of claim 1, wherein said carriage means includes a pair of frame members spaced one from the other to received therebetween a seat upon which a person may be seated, and cross-member means carried by said frame members and carrying said lifting means.

5. The apparatus of claim 4, including selectively adjustable positioning means mounting said frame means for selective positioning with respect to each other to selectively adjust the space therebetween.

6. The apparatus of claim 5, wherein said selectively adjustable positioning means includes an externally threaded shaft carried by at least one of said frame means and a selectively adjustable nut carried by said carriage means and coacting with said externally threaded shaft to adjust the position thereof with respect to said nut and thereby the position of one of said frame members with respect to the other of said frame members.

7. The apparatus of claim 6, wherein said selectively adjustable positioning means includes an externally threaded shaft carried by each of said frame members, and a selectively adjustable nut carried by said carriage means for each such externally threaded shaft for coaction therewith.

8. An invalid lift and transport apparatus; comprising:

(a) carriage means of a size and construction to carry a person;

(b) person lifting means carried by said carriage means for lifting and lowering a person with respect to said carriage means;

(c) person body support means carried by said lifting means;

(d) said person body support means including a first body support portion disposed to coact with a first portion of a person's body when disposed for coaction therewith, a second body support portion disposed to coact with a second portion of a person's body when disposed for coaction therewith and a third body support portion disposed to coact with a third portion of a person's body when disposed for coaction therewith;

(e) said first body support portion being readily positionable with respect to said lifting means to be carried thereby and readily removable from said lifting means;

(f) said second body support portion being readily positionable with respect to coacting with, and being carried by said first body support portion when said first body support portion is being carried by said lifting means; and (g) locking means disposed for coaction with both said third body support portion and said first body support portion such that said first body support portion is prevented from being positioned with respect to said lifting means to be carried thereby in a first condition of said locking means and is permitted to be positioned with respect to said lifting means to be carried thereby in a second condition of said locking means.

9. The apparatus of claim 8, wherein said lifting means includes a pair of spaced arms and said first body support portion includes a back support safety device carried by a pair of back support holders, each said back support holder locking means are carried by said lifting means for coaction with both said chest support portion and said back support portion; said locking means being responsive to a person's chest coacting with said chest support portion to enable said back support portion to be carried by said lifting means and thereby said leg support portion to be carried by said back support portion.

10. The apparatus of claim 9, wherein each of said spaced arms carries a substantially "C" shaped member defining a slot and each said back support holder includes a holding portion of a size and configuration to be removably received in a respective one of said slots and when so disposed to be positioned for coacton with said lifting means.

11. An invalid lift and transport apparatus; comprising:

(a) carriage means of a size and construction to carry a person;

(b) person lifting means carried by said carriage means for lifting and lowering a person with respect to said carriage means, and including a pair of spaced arms;

(c) person body support means carried by said lifting means; and (d) said person body support means including a first body support portion disposed to coact with a first portion of a person's body when disposed for coaction therewith, a second body support portion disposed to coact with a second portion of a person's body when disposed for coaction therewith and a third body support portion disposed to coact with a third portion of a person's body when disposed for coaction therewith;

(e) said first body support portion being readily positionable with respect to said lifting means to be carried thereby and readily removable from said lifting means;

(f) said first body support portion including a back support safety device carried by a pair of back support holders, each said back support holder being of a size and configuration and constructed to coact with and be carried by a respective one of said spaced arms; and (g) said second body support portion being readily positionable with respect to, coacting with, and being carried by, said first body support portion when said first body support portion is being carried by said lifting means.

12. The apparatus of claim 11, wherein each of said spaced arms carries a substantially "C" shaped member defining a slot and each such back support holder includes a holding portion of a size and configuration to be removably received in a respective one of said slots and when so disposed to be positioned for coaction with said lifting means.

13. An invalid lift and transport apparatus; comprising:

(a) carriage means of a size and construction to carry a person;

(b) person lifting means carried by said carriage means for lifting and lowering a person with respect to said carriage means;

(c) person body support means carried by said lifting means;

(d) said person body support means including a first body support portion disposed to coact with a first portion of a person's body when disposed for coaction therewith, a second body support portion disposed to coact with a second portion of a person's body when disposed for coaction therewith and a third body support portion disposed to coact with a third portion of a person's body when disposed for coaction therewith;

(e) said first body support portion being readily positionable with respect to said lifting means to be carried thereby and readily removable from said lifting means;

(f) said second body support portion being readily positionable with respect to said first body support portion when carried by said lifting means and coacting with said first body support portion to be carried thereby;

(g) said person lifting means including a pair of spaced arms and said first body support portion including a back support safety device carried by a pair of back support holders, each said back support holder being of a size and configuration and constructed to coact with and be carried by a respective one of said spaced arms;

(h) each of said spaced arms carrying a substantially "C" shaped member defining a slot and each such back support holder further including a holding portion of a size and configuration to be removably received in a respective one of said slots and when so disposed to be positioned for coaction with said person lifting means; and (i) each said back support holder in addition carrying a leg support element projecting outwardly therefrom and each said substantially "C" shaped member including an opening extending the length of the member and communicating with said slot such that when said back support holder is disposed in said slot said leg support element extends out through said opening for coaction with and to support and carry said second body support portion.

14. The apparatus of claim 13, wherein said second body support portion includes leg support means including a leg support for disposition beneath the legs of a person to be lifted and transported, said leg support means including clevises disposed at respective spaced ends thereof and including support elements each carried thereby and positioned for coaction with a respective one of said leg support elements, such that when mounted thereon said leg support means may be selectively raised or lowered by said lifting mechanism upon operation thereof.

15. The apparatus of claim 14, wherein said leg support elements are each in the configuration of rivet-like elements with a shank and a head and said support elements are in the form of openings each in a configuration to permit passage therethrough at a selective area thereof of said rivet head and capture of said rivet head at another portion thereof.

16. The apparatus of claim 15, wherein said support elements include at least one triangular opening extending through each said clevis.

17. The apparatus of claim 16, wherein each clevis includes a plurality of triangular openings extending therethrough and aligned one with the other between said clevises so that said leg support means may be adjustably positioned and carried by said back support holders.

18. The apparatus of claim 17, wherein said leg support includes a relatively rigid board like member of a size and configuration for disposition beneath a person's legs.

19. The apparatus of claim 18, wherein said leg support is to be disposed beneath a person's legs proximate their knees.

20. The apparatus of claim 19, wherein said leg support also includes belt means carried by said leg support for disposition about the legs of a person.

21. An invalid lift and transport apparatus; comprising:

(a) carriage means of a size and construction to carry a person;

(b) person lifting means carried by said carriage means for lifting and lowering a person with respect to said carriage means;

(c) person body support means carried by said lifting means;

(d) said person body support means including a first body support portion disposed to coact with a first portion of a person's body when disposed for coaction therewith, a second body support portion disposed to coact with a second portion of a person's body when disposed for coaction therewith and a third body support portion disposed to coact with a third portion of a person's body when disposed for coaction therewith;

(e) said first body support portion being readily positionable with respect to said lifting means to be carried thereby and readily removable from said lifting means;

(f) said second body support portion being readily positionable with respect to said first body support portion when carried by said lifting means and coacting with said first body support portion to be carried thereby;

(g) locking means being disposed for coaction with both said third body support portion and said first body support portion such that said first body support portion is prevented from being positioned with respect to said person lifting means to be carried thereby in a first condition of said locking means and is permitted to be positioned with respect to said person lifting means to be carried thereby in a second condition of said locking means;

(h) said person lifting means including a pair of spaced arms and said first body support portion including a back support safety device carried by a pair of back support holders, each said back support holder being of a size and configuration and constructed to coact with and be carried by a respective one of said spaced arms;

(i) each of said spaced arms carrying a substantially "C" shaped member defining a slot and each said back support holder including a holding portion of a size and configuration to be removably received in a respective one of said slots and when so disposed to be positioned for coaction with said person lifting means; and (j) each said back support holder carrying a leg support element projecting outwardly therefrom and each said substantially "C" shaped member including an opening extending the length of the member and communicating with said slot such that when said back support holder is disposed in said slot said leg support element extends out through said opening for coaction with and to support and carry said second body support portion.

22. The apparatus of claim 21, wherein said second body support portion includes leg support means including a leg support for disposition beneath the legs of a person to be lifted and transported, said leg support means including clevises disposed at respective spaced ends thereof and including support elements each carried thereby and positioned for coaction with a respective one of said leg support elements, such that when mounted thereon said leg support means may be selectively raised or lowered by said lifting mechanism upon operation thereof.

23. The apparatus of claim 22, wherein said leg support elements are each in the configuration of rivet-like elements with a shank and a head and said support elements are in the form of openings each in a configuration to permit passage therethrough at a selective area thereof of said rivet head and capture of said rivet head at another portion thereof.

24. The apparatus of claim 23, wherein said support elements include at least one triangular opening extending through each said clevis.

25. The apparatus of claim 24, wherein each clevis includes a plurality of triangular openings extending therethrough and aligned one with the other between said clevises so that said leg support means may be adjustably positioned and carried by said back support holders.

26. The apparatus of claim 25, wherein said leg support includes a relatively rigid board like member of a size and configuration for disposition beneath a person's legs.

27. The apparatus of claim 26, wherein said leg support is to be disposed beneath a person's legs proximate their knees.

28. The apparatus of claim 27, wherein said leg support also includes belt means carried by said leg support for disposition about the legs of a person.

29. An invalid lift and transport apparatus; comprising:

(a) carriage means of a size and construction to carry a person;

(b) person lifting means carried by said carriage means for lifting and lowering a person with respect to said carriage means;

(c) person body support means carried by said lifting means;

(d) said person body support means including a first body support portion disposed to coact with a first portion of a person's body when disposed for coaction therewith, a second body support portion disposed to coact with a second portion of a person's body when disposed for coaction therewith and a third body support portion disposed to coact with a third portion of a person's body when disposed for coaction therewith;

(e) said first body support portion being readily positionable with respect to said lifting means to be carried thereby and readily removable from said lifting means;

(f) said second body support portion being readily positionable with respect to said first body support portion when carried by said lifting means and coacting with said first body support portion to be carried thereby;

(g) locking means disposed for coaction with both said third body support portion and said first body support portion such that said first body support portion is prevented from being positioned with respect to said person lifting means to be carried thereby in a first condition of said locking means and is permitted to be positioned with respect to said person lifting means to be carried thereby in a second condition of said locking means;

(h) said locking means including:

(1) a locking lever pivotally carried by one of a pair of said spaced arms carried by said lifting means;

(2) a locking finger carried at one end of said locking lever and disposed for movement between a first position projecting through an opening formed through a "C" shaped member carried by one of said spaced arms and into said slot and the path of movement therein of a back support holder and a second position removed therefrom;

(3) an actuating finger carried by said locking lever at another end thereof and disposed for coaction with said third body support portion; and (4) spring means disposed for coaction with said actuating finger and urging same, said locking lever, and said locking finger into said first position.

30. The apparatus of claim 29, wherein said third body support portion includes a chest support pillow carried by said lifting mechanism to support the chest area of a person when carried by the apparatus and when the person is positioned against said third party support portion, pivot means mounting said chest support pillow proximate a predetermined edge thereof, another edge of said chest support pillow, opposite said predetermined edge, being disposed for coaction with said spring means to be urged thereby into a lifted position pivoted a predetermined amount about said pivot means; said chest support pillow upon having a force applied thereto as when a person's chest is disposed thereagainst pivoting against the urging of said spring means and coacting with said actuating finger of said locking lever to pivot same from said first position to said second position.

31. An invalid lift and transport apparatus; comprising:

(a) carriage means of a size and construction to carry a person;

(b) person lifting means carried by said carriage means for lifting and lowering a person with respect to said carriage means;

(c) person body support means carried by said lifting means;

(d) said person body support means including a first body support portion disposed to coact with a first portion of a person's body when disposed for coaction therewith, a second body support portion disposed to coact with a second portion of a person's body when disposed for coaction therewith and a third body support portion disposed to coact with a third portion of a person's body when disposed for coaction therewith;

(e) said first body support portion being readily positionable with respect to said lifting means to be carried thereby and readily removable from said lifting means;

(f) said second body support portion being readily positionable with respect to said first body support portion when carried by said lifting means and coacting with said first body support portion to be carried thereby;

(g) said third body support portion including a chest support pillow carried by said lifting mechanism with a pivot means mounting said chest support pillow for pivoting about a predetermined edge thereof and with adjustment means carried by said lifting means and coacting with said chest support pillow proximate another edge thereof opposite said predetermined edge thereof to selectively adjust the position of said another edge of said chest support pillow.

32. The apparatus of claim 31, wherein said adjustment means selectively pivots said chest support pillow to any selected angular disposition between a first extreme position at substantially six degrees to the horizontal and a second extreme position of substantially forty-five degrees to the horizontal.

33. The apparatus of claim 32, wherein said adjustment means includes a pair of adjustment members each disposed proximate a side edge of said chest support pillow proximate said another edge.

34. The apparatus of claim 33, wherein each said adjustment member is selectively adjustable to modify its respective length to provide said selective adjustments.

* * * * *